United States Patent [19]

Agnelli

[11] 4,007,515

[45] Feb. 15, 1977

[54] GARMENT FASTENER

[75] Inventor: Joseph F. Agnelli, Medford, N.Y.

[73] Assignee: The Raymond Lee Organization, Inc., New York, N.Y.

[22] Filed: Dec. 29, 1975

[21] Appl. No.: 644,603

[52] U.S. Cl. ..... 24/103

[51] Int. Cl.[2] ..... A44B 1/28

[58] Field of Search ..... 24/101 FS, 208 R, 213 C, 24/90 F, 90 PR, 103, 104

[56] References Cited

UNITED STATES PATENTS

| | | | |
|---|---|---|---|
| 437,992 | 10/1890 | Ingram | 24/90 W |
| 451,420 | 4/1891 | La Dow | 24/103 UX |
| 474,252 | 5/1892 | Jackson | 24/90 PR |
| 1,692,643 | 11/1928 | Forte | 24/90 PR UX |
| 1,720,408 | 7/1929 | Anderson | 24/208 R |
| 2,024,805 | 12/1935 | Place | 24/213 C |
| 2,048,812 | 7/1936 | Place | 24/213 C |
| 2,104,239 | 1/1938 | Place | 24/213 C |
| 2,124,252 | 7/1938 | Lavigne | 24/213 C |
| 2,748,517 | 6/1956 | Berkis | 24/90 PR UX |

FOREIGN PATENTS OR APPLICATIONS

| | | | |
|---|---|---|---|
| 167,692 | 5/1955 | Australia | 24/101 FS |
| 140,993 | 9/1930 | Switzerland | 24/101 FS |

*Primary Examiner*—Donald A. Griffin
*Attorney, Agent, or Firm*—Howard I. Podell

[57] ABSTRACT

A two-part detachable fastener for use as a button of a garment. The male member is formed of an inverted U-shaped pin which snaps into a restricted opening of a cap-like female member so as to fasten to one or more layers of a garment held between the male and female members. The pin of the male member is formed with an externally pointed mid-section, with the external opposed sides of the legs of the pin shaped as projecting teeth and with the end of each leg bent at right angles to the axis of the pin and enclosed in a circular hollow button.

3 Claims, 4 Drawing Figures

GARMENT FASTENER

SUMMARY OF THE INVENTION:

My invention is a two-part detachable fastener for use as a button of a garment. The male member is formed of an inverted U-shaped pin which snaps into a restricted opening of a cap-like female member so as to fasten to one or more layers of a garment held between the male and female members. The pin of the male member is formed with an externally pointed mid-section, with the external opposed sides of the legs of the pin shaped as projecting teeth and with the end of each leg bent at right angles to the axis of the pin and enclosed in a circular hollow button.

BRIEF DESCRIPTION OF THE DRAWINGS:

The objects and features of the invention may be understood with reference to the following detailed description of an illustrative embodiment of the invention, taken together with the accompanying drawings in which.

Figure 1:
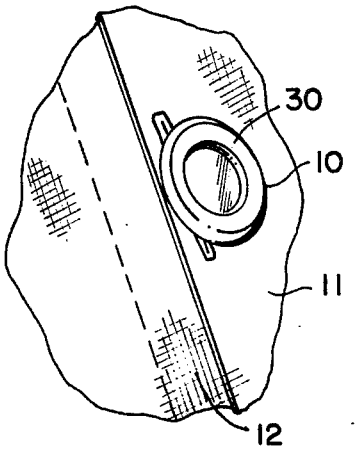
FIG. 1 is a perspective view of the invention.
Figure 2:
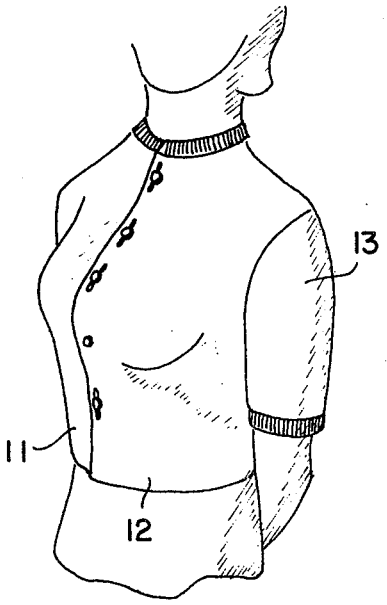
FIG. 2 is a perspective view of the invention in use.
Figure 3:
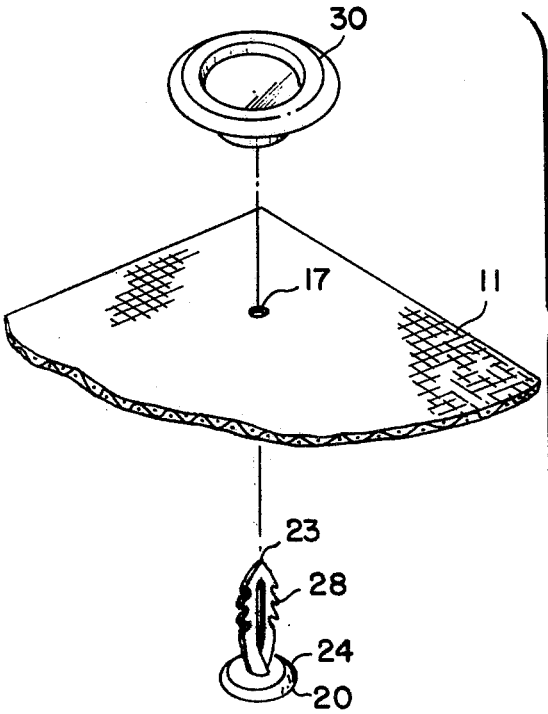
FIG. 3 is an exploded perspective view of the invention.
Figure 4:
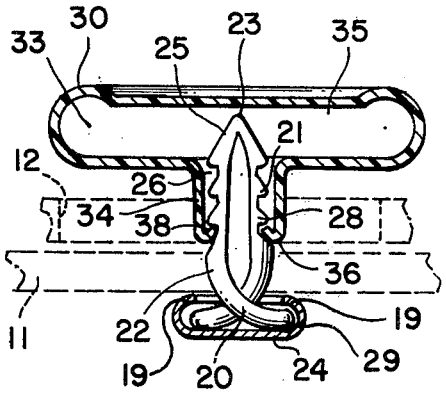
FIG. 4 is a sectional view of the invention.

DESCRIPTION OF THE PREFERRED EMBODIMENT:

Turning now descriptively to the drawings, in which similar reference characters denote similar elements throughout the several views, FIGS. 1–4 illustrate the fastener 10 which can fasten two layers 11 and 12 of a garment 13 together in a detachable manner.

Fastener 10 is formed of a male member 20 and a female cap 30.

Cap member 30 is formed as a circular hollow bottom section 33 joined to an open tubular neck section 34 to enclose a common interior compartment 35. The rim 36 of neck section 34 is formed with a circular flange 38 that extends inward into the interior of the neck section 34 away from the open mouth of the neck section 34.

Male member 20 is formed of a shaped pin 22 fastened to a circular cap 24, with pin 22 projecting from hollow flanged cap 24 in an inverted U-shaped configuration formed of two spaced leg members 21 extending to a common mid-section 25 formed with an external point 23. The opposed sides of each leg member 21 are formed with shaped recesses 26 bounding rachet shaped teeth 28 which grip the flange 38 of the mouth rim 36 of cap member 30 when the fastener 10 is assembled. Each end section 29 of a pin leg member 21 is bent to cross the other leg member 21 and fit under the flange 19 of cap 24 which flange 19 forms the rim of the mouth of cap 24. Leg members 21 may flex towards or away from each other, pivoting about mid-section 25, with end section 29 applying spring bias to flex leg members 21 away from each other so as to cause a pair of recesses 26 to clamp into the flange 38 of an attached cap 30.

A hole 17 may be formed in one layer 12 of a material to be fastened by pin 10, with hole 17, if desired, being of a diameter to accommodate neck 34 or alternately point 23 will form a hole through adjacent threads of a fabric without permanently distorting the fabric.

The length of leg members 21 and the length of neck section 34 may be proportionately varied to permit pin 10 to assemble various widths of material together. Similarly any one pin 10 may be employed to fasten a wide range of thickness of material together.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A fastener for detachable attachment through one or more layers of material, said fastener formed of a female member and a male member, said female member formed with a hollow neck section open at one end and formed about such opening with a flanged rim that extends into the opening, said male member formed of a pin shaped as a U-section of two resilient legs externally joined together at a first end section of each leg to form a common external point, with each of the second end sections of each leg slidably mounted in a common cap so as to permit flexing of the two legs towards or away from each other, with each said second end section of each leg mounted in said cap so as to apply spring bias to flex each of said legs away from the other said leg, said cap formed with a flange that restricts relative movement of the enclosed said second end sections to the cap in the axial direction of the said legs, said legs each formed externally with serrated surfaces so as to frictionally grip the rim of the female member when the leg sections are inserted in the neck section of the female member, said external point of the male member serving as a means of piercing the layers of material when the fastener is assembled with the female member located on one side of the material and the male member inserted into the female member from the second opposed side of the material.

2. The combination as recited in claim 1 in which the female member is externally shaped as a button joined to the neck section of the female member.

3. The combination as recited in claim 1 in which the serrated surfaces of the legs of the male member are each formed in the shape of a plurality of rachet teeth, said teeth shaped to engage the rim of the female member when the fastener is assembled.

* * * * *